US005579740A

United States Patent [19]

Cotton et al.

[11] Patent Number: 5,579,740

[45] Date of Patent: Dec. 3, 1996

[54] FUEL HANDLING SYSTEM

[75] Inventors: Kenneth J. Cotton, Caro; Ronald H. Roche, Cass City, both of Mich.

[73] Assignee: Walbro Corporation, Cass City, Mich.

[21] Appl. No.: 375,626

[22] Filed: Jan. 20, 1995

[51] Int. Cl.[6] ..... F02M 37/04

[52] U.S. Cl. ..... 123/516; 123/514

[58] Field of Search ..... 123/516, 514, 123/518, 506, 509, 557, 541

[56] References Cited

U.S. PATENT DOCUMENTS

| | | | |
|---|---|---|---|
| 2,414,158 | 1/1947 | Mock | 123/516 |
| 3,172,348 | 3/1965 | Berg | 123/518 |
| 4,279,232 | 7/1981 | Schuster | 123/516 |
| 4,703,736 | 11/1987 | Atkins | 123/516 |
| 4,844,704 | 7/1989 | Jiro | 123/516 |
| 4,878,518 | 11/1989 | Tuckey | 137/448 |
| 4,878,816 | 11/1989 | Tuckey | 417/76 |
| 4,893,647 | 1/1990 | Tuckey | 137/493 |
| 4,924,838 | 5/1990 | McCandless | 123/514 |
| 4,928,657 | 5/1990 | Asselin | 123/514 |
| 5,038,741 | 8/1991 | Tuckey | 123/509 |
| 5,096,391 | 3/1992 | Tuckey | 417/423.3 |
| 5,195,494 | 3/1993 | Tuckey | 123/514 |
| 5,263,459 | 11/1993 | Talaski | 123/516 |
| 5,309,885 | 5/1994 | Rawlings | 123/516 |
| 5,368,001 | 11/1994 | Roche | 123/510 |
| 5,375,578 | 12/1994 | Kato | 123/516 |
| 5,389,245 | 2/1995 | Jeager | 123/516 |

*Primary Examiner*—Carl S. Miller

*Attorney, Agent, or Firm*—Barnes, Kisselle, Raisch, Choate, Whittemore & Hulbert

[57] ABSTRACT

A fuel handling system for an internal combustion engine having a vapor separator for receiving fuel from a remote tank and a pump for delivering the fuel under high pressure to a fuel injector of the engine while providing vapor separation. The separator has an inlet for receiving fuel from the tank, an outlet for enabling fuel to be removed and delivered to the engine, at least one return for enabling fuel not used by the engine to be returned to the separator, and a vent for removing fuel vapor from a gas dome above a pool of liquid fuel within the separator. The inlet has a valve controlled by a float in the reservoir for admitting fuel to maintain the level of liquid fuel in the separator. To retard foaming and excessive vaporization of liquid fuel in the separator, the separator has a perforate baffle between any return and the liquid fuel pool. To prevent any stream of returned fuel, vapor and/or air from impinging against the fuel pool, the baffle preferably has a plurality of through-openings which enable liquid fuel to pass through the baffle to the pool while deflecting any return stream away from the fuel pool. The baffle preferably extends outwardly to the separator sidewall for preventing any return stream from passing around the baffle and directly impinging against the liquid fuel while at least slightly pressurizing gas below the baffle for controlling vapor venting to the engine.

30 Claims, 2 Drawing Sheets

FUEL HANDLING SYSTEM

FIELD OF THE INVENTION

This invention relates to fuel handling systems for internal combustion engines and more particularly to a fuel handling system for a fuel-injected marine internal combustion engine.

BACKGROUND OF THE INVENTION

Modern fuel-injected, fuel delivery systems are currently in use for supplying fuel to marine internal combustion engines because fuel injection precisely regulates fuel flow enabling accurate control of the air and fuel mixture entering the engine. This improves engine performance, particularly over the wide range of operating loads and conditions typically encountered by a marine engine providing better fuel efficiency while significantly reducing undesirable exhaust gas emissions.

During operation of a typical fuel handling system for a non-marine, fuel-injected, internal combustion engine, an electrically powered, high pressure fuel pump transfers liquid fuel from a remote tank, along a fuel line, into a fuel rail that communicates the fuel to individual fuel injectors of the engine. During engine operation, fuel not consumed by the engine is returned to the remote tank while unburned fuel vapor is typically remixed with air entering the engine or the fuel vapor is returned to a vapor storage container until it can be later remixed with engine intake air.

For the marine industry, exhaust gas emission regulations and the likely future trend of these regulations have made it highly desirable, and even virtually necessary, for engineers and designers to apply fuel injection systems to marine internal combustion engines used to power boats and other watercraft. However, because fuel handling for fuel injected fuel delivery systems requires fuel to be supplied to the engine at a high pressure of typically at least twenty pounds per square inch (PSI) or more, Coast Guard safety regulations designed to prevent marine engine and fuel handling system related fires and explosions have made use of fuel-injection technology for marine applications a challenge.

To comply with these Coast Guard safety regulations, which limit the length of pressurized fuel lines in marine fuel handling systems to no more than twelve inches, fuel is delivered by the high pressure fuel pump to the injectors from a fuel reservoir, referred to as a vapor separator, located close to the engine. A lower pressure fuel pump transfers fuel, as it is needed, from the remote fuel tank to the vapor separator so the high pressure pump always has an adequate supply of liquid fuel to deliver to the engine. Typically, to keep the length of the pressurized fuel line as short as possible, the high pressure fuel pump, vapor separator and pressurized fuel line are all carried by the engine and housed under its cowling.

Since it is impractical and possibly unsafe to return unused fuel to the remote fuel tank and because excess pressurized fuel not used by the injectors must also have a short return line preferably to conform to these same Coast Guard safety regulations, the reservoir also functions as a vapor separator. To perform as a vapor separator, the reservoir has a gas dome above a pool of liquid fuel in the reservoir. During operation, unused fuel and vapor is typically returned from the engine to the reservoir and vapor vented from the gas dome is mixed with air entering the engine to be burned during engine operation. An example of such a vapor separator is disclosed in U.S. Pat. No. 5,368,001.

Typically, pressurized fuel must be returned to the vapor separator because excess fuel is supplied by the fuel pump to ensure an adequate supply and fuel pressure at each fuel injector. In addition to pressurized fuel not used by the fuel injectors, unburned liquid fuel, fuel vapor and air from the engine are also returned to the separator. For example, in two-stroke marine engine applications, fuel collected in an unburned fuel collection system, called a puddle drain system, is periodically purged from the engine into the vapor separator to prevent the engine from running rich and thereby reducing its fuel economy and undesirably increasing exhaust gas emissions.

Unfortunately, fuel is often returned to the reservoir under high pressure as well as high velocity causing the returned fuel to undesirably foam in the reservoir. Additionally, air and fuel vapor being returned to the reservoir can stir up the pool of liquid fuel also causing fuel to foam and vaporize. Fuel foaming is highly undesirable because it can interfere with maintaining enough liquid fuel in the vapor separator for adequate high pressure fuel pump operation. Should the amount of foam in the reservoir become excessive, foam may be pumped to the engine resulting in lean engine operation, stalling or, even worse, overheating of the engine due to fuel starvation.

To reduce fuel foaming, a flat baffle constructed of solid sheet material has been used in the past as a barrier to prevent any stream of returned fuel, vapor and/or air from impinging against the liquid fuel in the vapor separator. Unfortunately, returned fuel often foams as it impinges against the solid baffle and this foam drops below into the pool of liquid fuel because of a gap between the outer edge of the baffle and the sidewall of the vapor separator. Additionally, fuel vapor and air returned to the vapor separator can pass through this gap around the baffle and churn up the liquid fuel, also causing foaming, while undesirably increasing fuel vaporization.

Too much fuel vapor in the separator is also undesirable because it can result in a great deal of fuel vapor being uncontrollably vented from the separator into the intake manifold of the engine, thereby resulting in rough engine operation, spark plug fouling, and increased exhaust gas emissions. Moreover, for two-stroke engines at wide open throttle (WOT) engine operating conditions, the puddle drain system can return a large amount of air to the vapor separator, pressurizing the separator and forcing an excess amount of fuel vapor to vent from the separator into the intake manifold, further compounding these problems.

Complicated mechanisms have been developed in response to these problems. To help control or at least reduce the amount of fuel vapor venting from the separator back into the engine, there usually is a check valve in the vent between the vapor separator and engine intake manifold. To better control and typically reduce the amount of air under high velocity returned by the puddle drain system, a complex mechanical valving system cooperates with the throttle so it opens periodically at idle and low speed engine operating conditions to return fuel and vapor and remains closed at WOT to prevent overpressurizing the vapor separator helping to ensure smoother engine operation.

Unfortunately, these mechanisms contribute additional cost to constructing each fuel handling system because of the additional components and extra assembly required. During manufacturing, this added complexity also can increase the number of fuel handling systems that are rejected during quality control inspection, requiring them to be expensively refurbished or scrapped. Just as bad, mechanisms of this complexity can become dirty, sticky or otherwise inoperable over time, reducing their effectiveness or even adversely affecting engine operation, requiring servicing. Finally, all of these mechanisms do not always suitably retard or prevent fuel foaming and excessive fuel vaporization.

SUMMARY OF THE INVENTION

A fuel handling system for an internal combustion engine, such as a marine outboard engine, having a vapor separator for receiving fuel under relatively low pressure from a remote fuel tank and having a fuel pump for delivering fuel under relatively high pressure to a fuel injector of the engine while enabling fuel vapor in the separator to be returned to the engine. The vapor separator has a housing with a top and bottom and a sidewall defining a reservoir for receiving a pool of liquid fuel therein while maintaining a gas dome above the liquid fuel. The vapor separator has an inlet for receiving fuel from the remote fuel tank, an outlet in communication with an inlet of the fuel pump enabling fuel to be withdrawn from the liquid fuel pool, at least one fuel return enabling fuel not used by the engine to be returned to the vapor separator, and a vapor vent for enabling fuel vapor to be removed from the gas dome and vented to the engine. To retard and preferably prevent liquid fuel in the pool from foaming while encouraging separation of liquid fuel from any return stream of fuel, vapor and/or air received from the engine, the vapor separator has a perforate baffle between any such return and the liquid fuel pool.

To controllably admit fuel from the remote tank into the vapor separator, the inlet has a valve that cooperates with a float for maintaining a desired liquid fuel level in the fuel pool so that the fuel pump always has an adequate supply of fuel during operation. If desired, the vapor separator can have a return from the fuel rail or a return from a pressure regulator downstream of the fuel pump for returning excess pressurized fuel to the vapor separator. Preferably, the separator also has a return for receiving fuel and vapor not consumed by the engine, such as from a puddle drain fuel return system of a two-stroke engine.

To retard and preferably prevent fuel foaming while encouraging separation of liquid fuel from any return stream by enabling liquid fuel to controllably pass through the perforate baffle and drop into the liquid fuel pool below the baffle, the baffle has through-openings or perforations for allowing liquid fuel to pass through while deflecting any return stream away from the liquid fuel pool in the separator. Preferably, liquid fuel returned to the vapor separator "percolates" downwardly through the openings in the baffle thereby retarding any fuel foam on or above the baffle from passing through the baffle and dropping into the fuel pool. Preferably, at least a portion of the baffle is inclined to a return stream and preferably the surface of the baffle is substantially non-planar to further encourage separation of liquid fuel entrained in any return stream while absorbing at least some momentum of each stream and deflecting each stream away from the liquid fuel pool. To create such a non-planar baffle, the baffle is preferably constructed of corrugated sheet, wire cloth, wire mesh or screen.

Preferably, the periphery of the baffle bears against the separator sidewall to prevent any return stream from passing around the baffle and impinging against the liquid fuel pool thereby preventing foaming and fuel vaporization. If the fuel pump is received in the vapor separator and through the baffle, the baffle preferably bears against the outer housing of the pump to prevent any return stream from passing between the baffle and the pump.

Preferably, the baffle divides the gas dome into an upper dome and a lower dome and the return stream creates a pressure differential across the baffle. This pressure differential causes the lower gas dome to be at least slightly pressurized for encouraging condensation of fuel vapor in the dome into liquid fuel while preventing fuel vaporization and retarding excess fuel vapor from being vented to the engine thereby preventing the engine from running rich and emitting undesirable exhaust gases.

Objects, features and advantages of this invention are to provide a fuel handling system which enables fuel to be transported from a remote tank under low pressure and pressurized at the engine for supplying highly pressurized fuel to a fuel injector of an internal combustion engine, has a vapor separator with a baffle therein for preventing any stream of returned fuel, vapor and/or air from directly impinging against a pool of liquid fuel in the separator for retarding fuel foaming and thereby preferably preventing fuel foaming from adversely affecting fuel pump operation and minimizing vaporization of liquid fuel in the separator, pressurizing at least a portion of the gas dome to prevent an excessive amount of fuel vapor from being uncontrollably Vented to the engine for preventing rich engine operation while encouraging condensation of fuel vapor into liquid fuel, reducing undesirable exhaust gas emissions and increasing fuel economy, encouraging separation of liquid fuel entrained in any vapor or gas stream returned to the separator, can be easily mounted under the cowling of a marine outboard engine in close proximity to the engine for enabling compliance with Coast Guard regulations requiring pressurized fuel lines to have a length no greater than twelve inches, and is of compact construction, and is rugged, durable, of simple design, of economical manufacture and easy to assemble and use.

BRIEF DESCRIPTION OF THE DRAWINGS

These and other objects, features and advantages of this invention will be apparent from the following detailed description of the best mode, appended claims and accompanying drawings in which:

DETAILED DESCRIPTION

Figure 1:
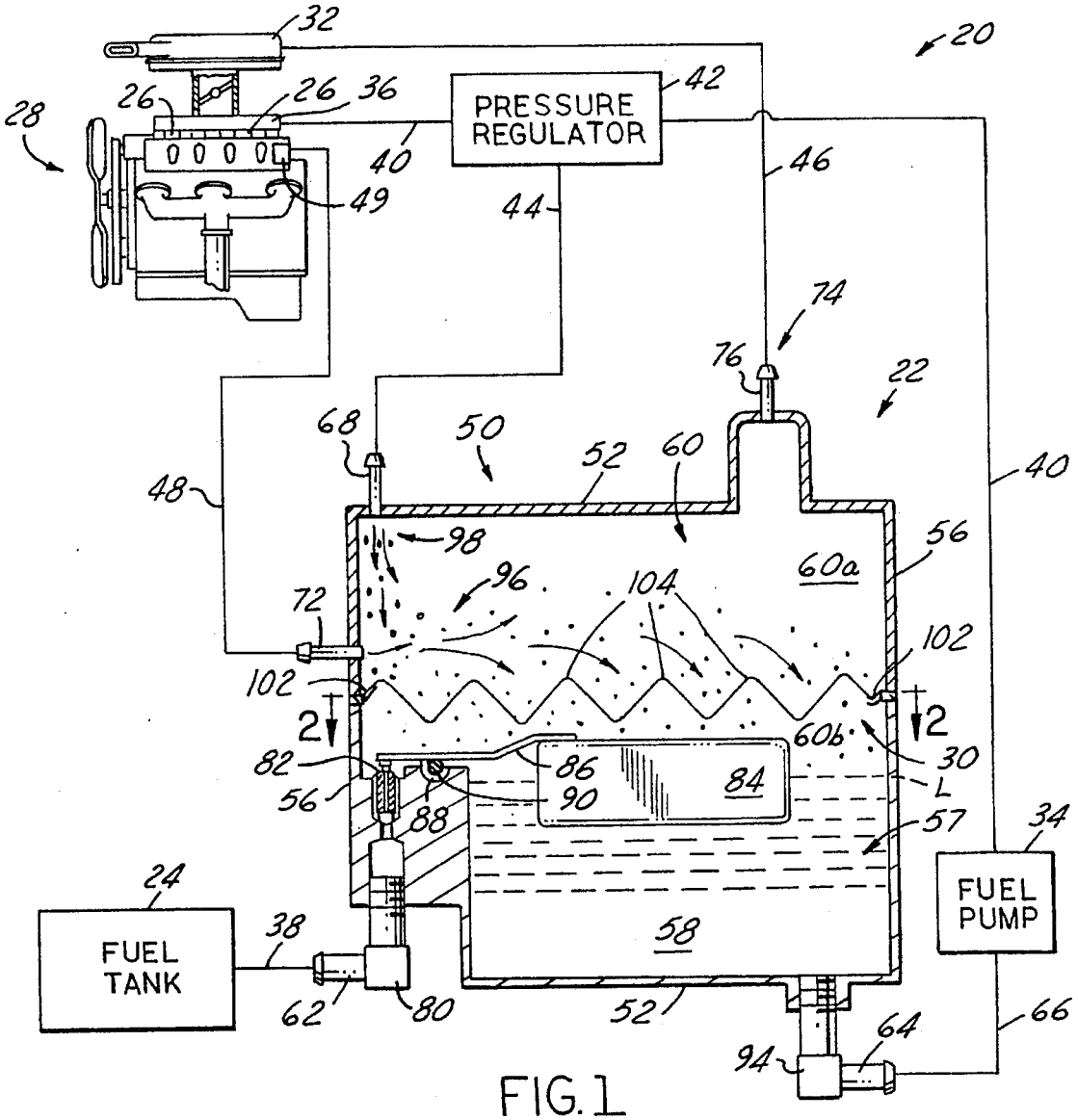
FIG. 1 illustrates a fuel handling system having a perforate baffle of this invention for preventing excess fuel vaporization and retarding fuel foaming.
Figure 2:
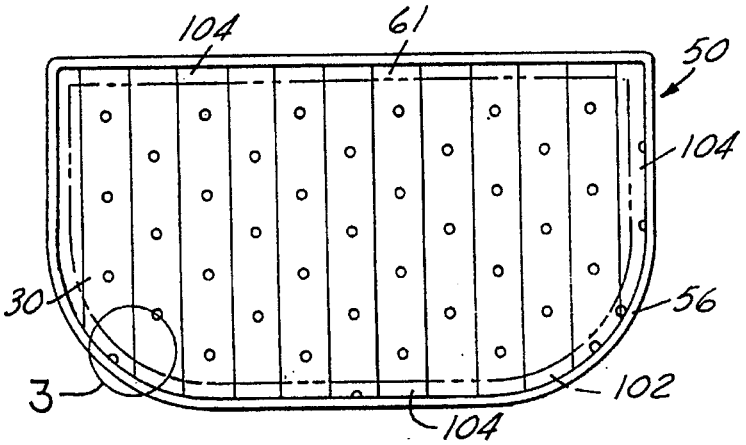
FIG. 2 is a sectional view of the vapor separator taken along line 2—2 of FIG. 1 illustrating a top view of the baffle.
Figure 3:
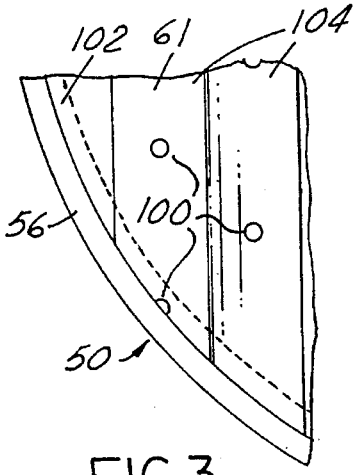
FIG. 3 is an enlarged fragmentary view of that portion of FIG. 1 of the baffle and vapor separator enclosed by the circle 3 illustrating in more detail the construction and arrangement of the baffle in the separator.

With reference to the drawings, FIGS. 1–3 illustrate a fuel handling system 20 having a vapor separator 22 of this invention for receiving fuel under low pressure from a remote source, such as a fuel tank 24, and delivering the fuel under high pressure to a fuel injector 26 of an internal combustion engine 28. The vapor separator 22 also receives unused and excess liquid fuel and fuel vapor from the engine 28 and vents fuel vapor from the separator 22 to the engine 28 for mixing it with air entering the engine 28 where it is later burned during engine operation. To retard and preferably prevent returned fuel from undesirably foaming and displacing liquid fuel in the separator 22 with foam, the vapor separator 22 has a baffle 30 between any fuel return and the liquid fuel in the separator 22.

Preferably, the engine 28 is a two-stroke or four-stroke fuel injected, internal combustion engine used for marine applications, such as an inboard or outboard engine for a boat. As is shown in FIG. 1, the engine 28 has an intake manifold 32 for receiving air and directing it into the engine 28 to be mixed with fuel to be combusted during engine operation. Fuel from the vapor separator 22 is delivered under high pressure by a fuel pump 34 to a fuel rail 36 on the engine 28 that communicates fuel to each injector 26. During engine operation, each injector 26 sprays a precise amount of fuel from the rail 36 that is mixed with air from the intake manifold 32 before it enters the engine 28 to ensure efficient engine operation.

As is shown in block diagram form in FIG. 1, the remote fuel tank 24 is connected by a fuel line 38 to the vapor separator 22. Although not shown in the drawings, a low pressure fuel pump, that preferably is directly powered by the engine 28, draws fuel from the tank 24 and pumps it under relatively low pressure to the vapor separator 22. If the engine 28 is a two-stroke engine, the low pressure pump preferably is a pulse-type fuel pump powered by changes in engine crankcase pressure during engine operation. If the engine is a four-stroke engine, the fuel pump preferably is a mechanical fuel pump that is driven by the engine camshaft or distributor shaft.

To supply fuel from the vapor separator 22 to the engine 28, the high pressure fuel pump 34 draws liquid fuel from the separator 22 and transports it through a fuel line 40 to the fuel rail 36 of the fuel injection system. Preferably, there is also a pressure regulator 42 downstream of the fuel pump 34 and upstream of the fuel rail 36 for regulating fuel pressure to each injector 26. To return excess fuel not required by the injectors 26, the pressure regulator 42 has a fuel return line 44 that returns the excess fuel to the vapor separator 22. Although FIG. 1 illustrates fuel being returned from the pressure regulator 42, the vapor separator 22 and baffle 30 of this invention could also be used with a system having a fuel return line from the fuel rail 36 to the vapor separator 22. Alternatively, the vapor separator 22 and baffle 30 of this invention are also well suited for use with a returnless, fuel injected, fuel delivery system.

A high pressure fuel pump having this construction capable of supplying fuel under a pressure of at least twenty pounds per square inch (PSI) is disclosed in U.S. Pat. No. 5,248,223 assigned to the assignee hereof, incorporated by reference herein, and to which reference may be had for a more detailed background discussion of such pump structure and operation. To enable fuel vapor to be vented from the vapor separator 22, there is a vent line 46 from the vapor separator to the engine 28 to communicate fuel vapor from the separator 22 to air entering the engine 28 through its intake manifold 32 for being mixed with incoming air. Preferably, the vent line 46 extends from the separator 22 to the intake manifold 32 for enabling fuel vapor from the separator 22 to be mixed with the air entering the engine. Preferably, there also is a return line 48 from the engine 28 to the separator 22 for returning unused liquid fuel and vapor from the engine 28 to the separator 22. If the engine 28 is a two-stroke engine, the fuel return line 48 communicates with a puddle drain system 49 of the two-stroke engine, as is depicted in FIG. 1, for returning unburned liquid fuel and fuel vapor to the separator 22.

The vapor separator 22 has a housing 50 with a top wall 52 and a bottom wall 54 spaced apart by a sidewall 56 for defining a reservoir 57 for containing a pool of liquid fuel 58 therein while maintaining a gas dome 60 holding a mixture of air and fuel vapor above the liquid fuel pool 58. To admit fuel from the remote tank 24 and enable liquid fuel to be removed from the reservoir 57, the vapor separator housing 50 has a fuel inlet nipple 62 fluidtightly connected to the fuel line 38 from the tank 24 and an outlet nipple 64 connected by a fuel line 66 to the inlet of the high pressure fuel pump 34. The separator 22 also has an inlet nipple 68 sealingly connected to the return line 44 from the pressure regulator 42 and another inlet nipple 72 sealingly connected to the return line 48 from the engine 28 for enabling unused and excess liquid fuel, fuel vapor, and air to be returned to the vapor separator 22. So that fuel vapor can be removed from the gas dome 60 within the separator 22 and vented to the engine 28, the separator 22 has a vent 74 with a nipple 76 sealingly connected to the vent line 46.

So that fuel can be admitted from the remote tank 24, the fuel inlet nipple 62 is part of a fitting 80 that is preferably threadably and fluid tightly received in the separator housing 50. To controllably admit fuel into the separator 22 to maintain the level of the pool of liquid fuel 58 within the reservoir 57, the fitting 80 communicates with an inlet valve 82 operably connected to a float 84. The inlet valve 82 rides on one end of a lever 86 extending from the float 84 with a curled finger 88 of the lever 86 being received around a pivot 90, preferably molded in the housing 50, for urging the valve 82 to close and thereby prevent fuel from entering the separator 22 when the pool of liquid fuel 58 in the separator 22 has reached a desired predetermined level, such as "L" shown in FIG. 1. To enable fuel to be drawn from the separator reservoir 57, the fuel outlet nipple 64 is part of a, preferably, right-angled fitting 94 that is preferably threadably received in an opening in the bottom 54 of the vapor separator housing 50.

To prevent returned liquid fuel, fuel vapor and air from directly impinging against the liquid fuel in the vapor separator 22 and causing undesirable fuel foaming, the vapor baffle 30 is positioned within the separator 22 below the engine return 72 and pressure regulator return 68 and above the pool of liquid fuel 58 in the separator reservoir 57. As is shown in FIG. 1, the baffle 30 preferably divides the vapor dome into an upper dome **60*a* and a lower dome 60*b*. Preferably, the baffle 30 is constructed of a sheet 61** of material that is not adversely affected by exposure to fuel, such as a metal or a plastic impervious to hydrocarbon based fuel.

To enable liquid fuel and fuel vapor that has condensed into liquid fuel to be separated from any stream 96 & 98 of fuel, vapor and/or air returned to the vapor separator 22 and passed through the baffle 30 into the pool of liquid fuel 58 below the baffle 30, while retarding and preferably preventing any foam that has formed on or above the baffle 30 from dropping into the fuel pool 58, the baffle 30 has through-openings or perforations 100 that extend completely through the baffle 30. Preferably, the baffle 30 has a plurality of perforations or through-openings 100 to permit relatively large amounts of returned liquid fuel to pass or "percolate"

through the baffle 30 and drop into the pool of liquid fuel 58 below the baffle 30. Preferably, the size of each through-opening 100 is large enough to allow liquid to pass through the baffle 30, yet small enough to retard and preferably substantially prevent foam above the baffle 30 and on top of the baffle 30 from passing through the baffle and falling below into the liquid fuel pool 58. Preferably, the size, number and pattern of distribution of these through-openings 100 can be optimized empirically through routine experimentation and testing so that the passage of liquid fuel through the baffle 30 is optimized while passage of any foam above the baffle 30 is retarded and preferably substantially prevented.

These perforations or through-openings 100 permit liquid fuel passage through the baffle 30 while preventing returned air, vapor and liquid fuel at high velocity from directly impinging against the pool of liquid fuel 58 in the vapor separator 22 thereby preventing foam from forming in the liquid fuel pool 58. The baffle 30 does so by deflecting any return stream 96 & 98 away from the liquid pool of fuel 58 thereby significantly reducing the velocity of any liquid, vapor and/or air that passes through the baffle openings 100. Preferably, the baffle also dissipates at least a portion of the momentum of the return streams 96 & 98. Preferably, the baffle 30 and openings 100 substantially reduce the velocity of any returned liquid fuel that passes through the baffle 30 so that it simply falls downwardly into the liquid fuel pool 58 below the baffle 30.

Preferably, at least a portion of the baffle 30 is inclined to at least one of the return streams 96 & 98 for encouraging separation of liquid fuel from the return stream 96 and/or 98. To encourage separation of liquid fuel entrained in any return stream 96 & 98, the baffle 30 preferably has a non-planar surface to encourage separation and thereby increase and maximize fuel recovery. Preferably, the non-planar baffle 30 also encourages condensation of fuel vapor 22 into liquid fuel to increase and maximize fuel recovery.

As is shown more clearly in FIGS. 1 & 3, the baffle 30 preferably has a series of bends or corrugations 104 for encouraging liquid fuel separation and condensation of fuel vapor into liquid fuel. As is shown in FIG. 1, the amplitude of the corrugations 104 and distance between corrugations 104 result in sections of each baffle corrugation 104 that are inclined approximately 45° to the plane of the baffle 30 for preferably maximizing separation of liquid fuel from any stream 96 or 98 returned to the vapor separator 22. Preferably, however, the amplitude of the corrugations 104 and distance between the peak of one corrugation 104 to the next corrugation 104 is empirically optimized through routine experimentation for optimizing fuel separation from the return streams 96 & 98.

Preferably, as is shown more clearly in FIG. 2, the baffle 30 completely overlies the top surface of the pool of liquid fuel 58 preventing the liquid fuel pool 50 from being directly exposed to any return stream 96 & 98. As is also shown in FIG. 2, the baffle 30 preferably extends from side to side of the separator housing 50 completely overlying the pool of liquid fuel 58 for preventing any return stream 96 & 98 from passing around the baffle 30 and churning liquid fuel in the pool 58 into foaming. Preferably, the outer periphery of the baffle 30 bears against the sidewall 56 of the separator housing 50 for minimizing any gap between the baffle 30 and the separator housing sidewall 56 for preventing any return stream 96 & 98 from passing around the baffle 30 and directly impinging against the liquid fuel in the pool 58.

Preferably, there is substantially no gap between the baffle 30 and the housing sidewall 56 so that any stream of returned fuel vapor and/or air 96 & 98 causes a pressure differential to be created between the upper gas dome **60*a* and lower gas dome 60*b* increasing the pressure in the lower gas dome 60*b* thereby encouraging condensation of fuel vapor in the lower gas dome 60*b* while minimizing and preferably preventing vaporization of liquid fuel in the fuel pool 58. This pressurization of the lower gas dome 60*b* also preferably prevents excess fuel vapor from being vented from the gas dome 60 to the engine 28 during engine operation for maintaining smooth and efficient engine operation. Preferably, the baffle 30 can be constructed and arranged so it substantially seals against the separator housing sidewall 56 to maximize the pressure differential between the upper gas dome 60a and lower gas dome 60*b***.

As is shown in phantom in FIGS. 2 and 3, the vapor baffle 30 preferably has a downturned and overlapping lip 102 about its periphery. If desired, however, the lip 102 may be angled upwardly or downwardly so that it preferably bears against the separator housing sidewall 56 to minimize or virtually eliminate any gap therebetween.

Figure 4:
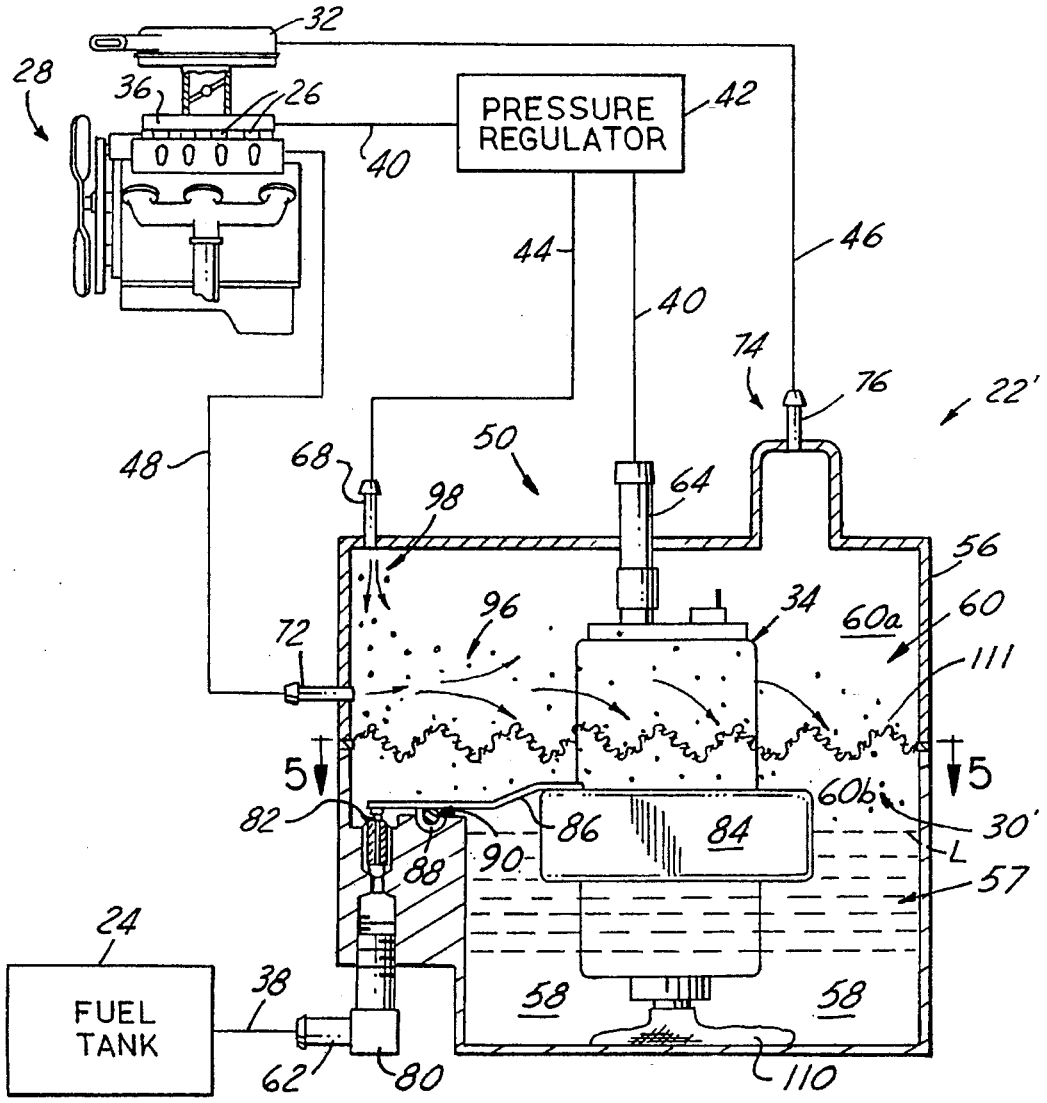
FIG. 4 is a sectional view of the fuel handling system having a fuel pump within the separator and received through a second baffle embodiment.
Figure 5:
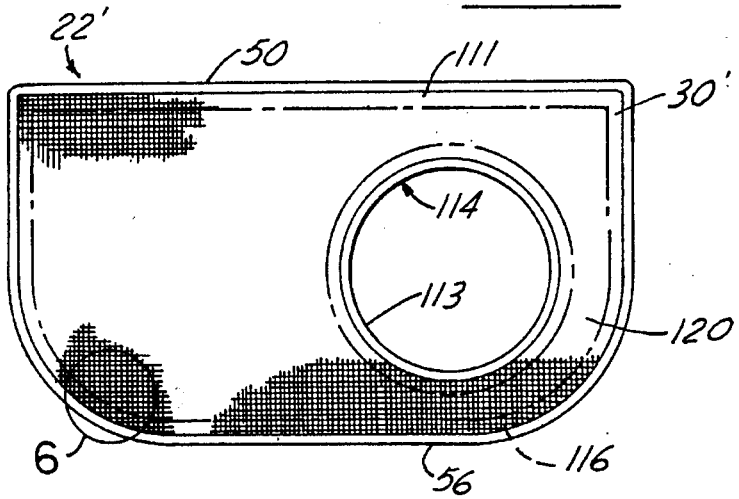
FIG. 5 is a sectional view of the vapor separator taken along line 5—5 of FIG. 4 illustrating more clearly the second baffle.
Figure 6:
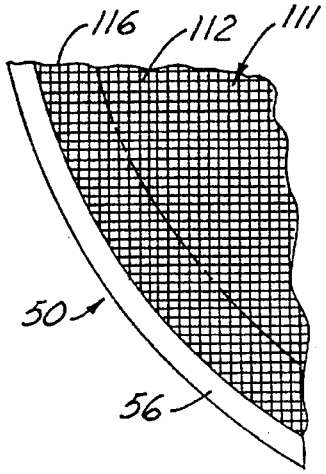
FIG. 6 is a fragmentary view on an enlarged scale of that portion of FIG. 5 of the vapor separator and baffle enclosed by the circle 5 and illustrating in more detail the construction of the second baffle.

FIGS. 4–6 illustrate a second preferred embodiment of the vapor separator 22' of this invention having the high pressure fuel pump 34 received within the vapor separator 22' and through the baffle 30' for minimizing the amount of space the fuel handling system 20 requires. As is shown in FIG. 4, the outlet of the fuel pump 34 has a filter sock 110 for preventing dirt, sediment and other particulate matter from entering the fuel pump 34. Should it be desirable to provide a fuel handling system 20 without a pressure regulator, the fuel pump 34 may be of a construction having a pressure relief valve for expelling excessively pressurized fuel from the pump back into the vapor separator 22. A fuel pump having such a relief valve is disclosed in U.S. Pat. No. 5,248,223, the disclosure of which is hereby incorporated by reference. Alternatively, a fuel pick-up having the description contained in U.S. Pat. No. 5,368,001, the disclosure of which is hereby incorporated by reference, may be used in place of the filter sock 110 for admitting only liquid fuel to the pump 34 while filtering the fuel before it enters the pump inlet and preventing air, fuel vapor, and foam from entering the pump 34. If such a pick-up is used, it is preferably constructed in accordance with U.S. Pat. No. 5,170,764, the disclosure of which is incorporated herein by reference.

As is shown in FIGS. 5 & 6, the baffle 30' of the vapor separator 22' is preferably constructed of a wire mesh, screen or wire cloth 111 with a plurality of through-openings 112 between woven strands of the baffle 30' for enabling liquid fuel and condensed fuel to pass through the baffle 30' while retarding and preferably preventing fuel foam from passing through the baffle into the pool of liquid fuel 58 in the vapor separator 22'. Preferably, the material 111 used to construct the baffle 30' is pre-pleated wire cloth and preferably the wire cloth is constructed of 304 stainless steel or its equivalent. If constructed of an equivalent, the equivalent is preferably also not adversely affected by exposure to hydrocarbon based fuel. Although the baffle 30' may be corrugated as is shown in FIG. 5, it may also be flat or substantially planar as is more clearly depicted in FIGS. 5 & 6.

As is shown in FIG. 5, the baffle 30' preferably has a ring 113 with a through-opening 114 of sufficiently large diameter to receive the fuel pump 34 therethrough. Preferably, the ring 113 bears against the outer housing of the fuel pump 34 to minimize any gap between the baffle 30' and pump 34 for preventing any return stream 96 or 98 from passing between the baffle 30' and pump 34 and impinging against the liquid fuel pool 58. Preferably, the diameter of the opening 114 is slightly less than the outer diameter of the fuel pump 34 to provide a slight interference fit with the fuel pump 34 when it is inserted through the baffle opening 114 so that it preferably substantially seals against the outer housing of the fuel pump 34 to maximize any pressure differential created across the baffle 30' during operation. Preferably, the outer periphery of the baffle 30' is pleated and has a finished edge 116 so the wire doesn't fray during insertion and after being inserted into the vapor separator 22'.

In use, the vapor separator 22 is preferably installed in close proximity to the engine 28, such as under the cowling of a marine inboard or outboard motor. Preferably, to satisfy Coast Guard safety regulations, the separator 22 is installed close enough to the engine 28 so that fuel under high pressure is delivered to the engine 28 using a fuel line 40 having a maximum length of one foot and that any return line preferably also has a maximum length of one foot, particularly, if fuel returned to the separator 22 is under pressure.

In operation, when the pool of liquid fuel 58 in the vapor separator 22 drops below the desired level, such as "L" shown in FIGS. 1 & 4, the inlet valve 82 opens, allowing fuel from the remote tank 24 to enter the separator 22. When the pool of liquid fuel 58 in the vapor separator 22 reaches the desired level, "L", the float 84 pivots the lever arm 86 counter clockwise (as viewed in FIGS. 1 & 4) closing the inlet valve 82 to prevent any more fuel from the fuel tank 24 from entering the separator 22. The fuel pump 34 draws fuel from the separator 22 and delivers it to the fuel pressure regulator 42. Fuel passing through the pressure regulator 42 enters the fuel rail 36 where it is communicated to each injector 26 of the engine. During engine operation, fuel is precisely metered by each injector 26 and mixed with air that has entered the engine through the intake manifold 32 to ensure steady and efficient engine operation.

As is shown by return streams 96 & 98 in FIGS. 1 & 4, fuel, vapor and air returned to the separator 22 typically has a considerable velocity. As it enters the vapor separator 22, it impinges against the baffle 30 causing liquid fuel entrained in any return stream 96 & 98 to be separated from the stream and more slowly pass through the baffle 30 into the pool of liquid fuel 58 below.

Excess fuel not required by the fuel pressure regulator 42 is returned back to the vapor separator 22 through the regulator fuel return line 44. As the pressurized return fuel stream 98 enters the vapor separator 22, it sprays against and falls onto the baffle 30. The baffle 30 deflects and absorbs some of the force of the liquid fuel stream 98 to prevent the fuel from directly impinging against liquid fuel 58 in the separator 22 and causing fuel foaming. After impinging against the baffle 30, liquid fuel from the return stream 98 simply passes controllably through the baffle through-openings 100 or 112 into the liquid fuel pool 58 below the baffle 30.

During engine operation, fuel being dispensed by each injector 26 is mixed with air from the intake manifold 32 and burned during engine operation. However, liquid fuel and vapor not consumed by the engine is preferably returned to the vapor separator 22 through the engine return line 48 for subsequent re-use. For example, if the engine 28 is a two-stroke engine, fuel that has condensed into liquid in the engine 28, as well as unburned fuel vapor, is collected by the puddle drain system 49 and returned to the vapor separator 22 for re-use.

Additionally, the stream 96 of returned fuel, vapor and/or air returned from the engine 28 impinges against the corrugations 104 of the baffle 30 of FIG. 1 or the wire mesh 111 of the baffle 30' of FIG. 4, increasing separation of the liquid fuel from the return stream 96 while absorbing at least some of the force of the return stream 96 thereby slowing its velocity. As the return stream 96 from the engine 28 contacts the baffle 30, it is also deflected away from the liquid fuel pool 58 also preventing churning of the liquid fuel 58 thereby retarding fuel foaming and vaporization. This also prevents virtually any swirling in the lower gas dome 60b further retarding and preferably preventing fuel foaming and vaporization of fuel in the liquid fuel pool 58 by preventing churning of the pool 58.

As the return streams 96 & 98 contact the baffle 30 during operation, one or both of the streams preferably also cool the baffle 30 at least slightly, encouraging fuel vapor to condense into liquid on the baffle 30 and drop into the liquid fuel pool 58. Preferably, if the vapor separator 22 and baffle 30 become hot during engine operation, any liquid fuel on the baffle 30 that vaporizes preferably also evaporatively cools the baffle 30 to prevent further fuel vaporization while encouraging condensation of fuel vapor into liquid fuel.

Since the baffle 30 preferably bears against the vapor separator sidewall 56 minimizing any gap therebetween, returned fuel, vapor and air preferably causes at least a slight pressure differential across the baffle 30 increasing the pressure, at least slightly, of the lower gas dome **60*b* for encouraging condensation of fuel vapor in the dome 60*b* while minimizing vaporization of liquid fuel in the pool 58. This design also prevents excess fuel vapor in the dome 60 from being drawn through the fuel vapor vent 74 of the separator 22 into the intake manifold 32 thereby preventing the engine 28 from running rich. As a result of the lower gas dome 60*b* being pressurized relative to the upper gas dome 60*a* during operation, more fuel vapor is preferably retained in the lower gas dome 60*b* causing air and/or fuel vapor in the upper gas dome 60*a* to be more controllably drawn from the upper gas dome 60*a* through the vent 74 into the engine 28 to controllably consume fuel vapor while preventing the engine 28** from running rich, thereby reducing undesirable exhaust gas emissions and increasing fuel economy.

While the present invention has been disclosed in connection with the preferred embodiments thereof, it should be understood that there will be other embodiments which fall within the spirit and scope of the invention and that the invention is susceptible to modification, variation and change without departing from the scope and fair meaning of the following claims.

We claim:

1. A fuel handling system for an internal combustion engine having at least one fuel injector comprising:

a reservoir for receiving fuel therein having a pool of liquid fuel and maintaining a gas dome above said liquid fuel;

an inlet for enabling said reservoir to receive fuel from a remote source;

an outlet for enabling removal of fuel from said pool;

a fuel pump in communication with said outlet for delivering fuel from said reservoir to the fuel injector;

a return in communication with the reservoir for returning a stream of fuel to said reservoir above said pool of liquid fuel in said reservoir;

a perforate baffle in said reservoir below said return and spaced from and above said liquid fuel in said reservoir and above said inlet for permitting liquid fuel from said return to pass through said baffle and be received by said pool of liquid fuel in said reservoir.

2. The fuel handling system of claim 1 wherein said perforate baffle has a plurality of through-openings therein for facilitating separation of liquid fuel from said return stream and permitting liquid fuel to pass through said baffle into said pool of liquid fuel while preventing said stream of fuel from directly impinging against said pool of liquid fuel to retard fuel vaporization and fuel foaming.

3. The fuel handling system of claim 1 wherein said baffle comprises a solid sheet having a plurality of through-openings therein for permitting returned fuel to pass through said baffle while retarding foam from reaching said pool of liquid fuel.

4. The fuel delivery system of claim 1 wherein said baffle comprises a sheet having at least one bend in said sheet for inclining at least a portion of said baffle relative to said stream of returned fuel to encourage separation of liquid fuel from said stream of returned fuel.

5. The fuel delivery system of claim 4 wherein said baffle has a plurality of corrugations for encouraging separation of liquid fuel entrained in said stream of returned fuel.

6. The fuel handling system of claim 1 wherein said baffle comprises a wire mesh having a plurality of passages therethrough for enabling liquid fuel to pass through said mesh into said pool of liquid fuel and encouraging separation of liquid fuel from said stream of returned fuel while substantially deflecting said stream from impinging directly against said pool of fuel.

7. The fuel handling system of claim 6 wherein said baffle is constructed of 304 stainless steel wire cloth.

8. The fuel handling system of claim 1 wherein said reservoir has a bottom wall and a sidewall in communication with said bottom wall defining a container for receiving liquid fuel therein and maintaining said gas dome above said liquid fuel and wherein the periphery of said baffle extends outwardly adjacent said sidewall to minimize any gap between said sidewall and said baffle for at least substantially preventing said stream of fuel from passing around said baffle and impinging against said liquid fuel.

9. The fuel handling system of claim 8 wherein said periphery of said baffle abuts against said sidewall so that there is substantially no gap between said baffle and said sidewall for at least substantially preventing said stream of fuel from impinging against said pool of liquid fuel in said reservoir.

10. The fuel handling system of claim 8 wherein said baffle is spaced from said liquid pool of fuel dividing said vapor dome into a lower vapor dome between said liquid fuel and baffle and an upper vapor dome on the opposite side of said baffle and wherein the pressure of gas in said lower vapor dome is at least slightly greater than the pressure of gas in said upper vapor dome for retarding said liquid fuel from vaporizing while encouraging condensation of fuel vapor into liquid in said lower vapor dome.

11. The fuel handling system of claim 1 wherein said return stream cools said baffle encouraging fuel vapor contacting said baffle to condense into liquid.

12. The fuel handling system of claim 1 wherein liquid fuel on said baffle that vaporizes evaporatively cools said baffle, thereby lowering its temperature for retarding liquid fuel on said baffle from vaporizing and encouraging fuel vapor contacting said baffle to condense into liquid.

13. The fuel handling system of claim 1 wherein said baffle is disposed above said pool of liquid fuel and below said return.

14. The fuel handling system of claim 1 also comprising a vent in communication with said reservoir for permitting removal of gas from said dome.

15. The fuel handling system of claim 14 wherein said vent is disposed in said gas dome in communication with said dome for permitting removal of fuel vapor from said dome.

16. The fuel handling system of claim 14 wherein said baffle is disposed above said pool of liquid fuel and below said vent.

17. The fuel handling system of claim 1 also comprising a fuel return in communication with the fuel injector and said reservoir for returning excess fuel to said reservoir and wherein said baffle is disposed between said pool of liquid fuel and said excess fuel return for preventing excess fuel returned to said reservoir from impinging directly against said pool of liquid fuel to prevent fuel foaming.

18. The fuel handling system of claim 1 also comprising a fuel pressure regulator in communication with said fuel pump for regulating the pressure of fuel being delivered to the fuel injector, a return in communication with said reservoir and said pressure regulator for returning excess fuel from said fuel pressure regulator to said reservoir and wherein said baffle is disposed between said pool of liquid fuel and said excess fuel return for preventing excess fuel returned to said reservoir from impinging directly against said pool of liquid fuel to prevent fuel foaming.

19. The fuel handling system of claim 1 wherein the engine is a two-stroke engine.

20. The fuel handling system of claim 1 wherein the engine is a four-stroke engine.

21. The fuel handling system of claim 1 wherein the engine is a marine internal combustion engine and said reservoir is in close proximity to said marine internal combustion engine.

22. The fuel handling system of claim 1 wherein the engine is a two-stroke engine having a puddle-drain system in communication with said return for collecting excess fuel and fuel vapor from said two-stroke engine and returning said collected fuel to said reservoir.

23. The fuel handling system of claim 1 wherein said return is disposed in said vapor dome and above said baffle.

24. A fuel handling system for a marine internal combustion engine having at least one fuel injector comprising:

a vapor separator having spaced apart top and bottom walls and a sidewall defining a reservoir for receiving a pool of liquid fuel therein and maintaining a gas dome above said liquid fuel in said reservoir;

an inlet in communication with said reservoir for enabling said reservoir to receive liquid fuel from a remote source;

a vent in communication with the gas dome of said reservoir and the engine for permitting removal of fuel vapor from said reservoir and delivery to the engine for utilization by the operating engine;

an outlet for enabling removal of liquid fuel from said reservoir;

a fuel pump in communication with said outlet for delivering fuel from said reservoir to the fuel injector;

a return in communication with said reservoir for returning a stream of fuel to said reservoir; and a baffle in said reservoir between said return and said liquid fuel and above said inlet and spaced from and above said liquid fuel in said reservoir and having a plurality of openings through said baffle for permitting returned fuel to pass through said baffle openings to be received by said liquid fuel in said reservoir while substantially preventing said returned fuel from impinging directly on said liquid fuel and retarding fuel foaming for preventing fuel foam from adversely affecting fuel pump or engine operation.

25. The fuel handling system of claim 24 wherein the periphery of said baffle extends outwardly to said sidewall of said reservoir so that there is substantially no gap between said baffle and said sidewall for preventing said returned fuel from passing around said baffle and directly impinging against said liquid fuel in said reservoir.

26. The fuel handling system of claim 24 wherein said baffle is constructed of a solid sheet having a plurality of through-openings therein to permit liquid fuel to flow through said baffle while retarding fuel foaming in said liquid fuel in said reservoir and said baffle having at least one corrugation for encouraging separation of liquid fuel from said returned fuel for being received by said liquid fuel in said reservoir.

27. The fuel handling system of claim 24 wherein said baffle comprises a wire mesh screen having a plurality of openings therethrough for enabling liquid fuel to pass through said screen and encouraging separation of liquid fuel from said returned fuel for being received by said liquid fuel in said reservoir while collecting foam on said screen for at least substantially preventing said foam from dropping into said liquid fuel in said reservoir.

28. A fuel handling system for an internal combustion engine having at least one fuel injector comprising, a reservoir for receiving a pool of liquid fuel therein and maintaining a gas dome above said liquid fuel;

an outlet for enabling removal of liquid fuel from said pool of liquid fuel;

a fuel pump in communication with said outlet for delivering fuel from said reservoir to the fuel injector of the engine;

a return in communication with the gas dome of the reservoir for returning a stream of fuel to said reservoir above said pool of liquid fuel in said reservoir;

a baffle in said reservoir between said return and said pool of liquid fuel in said reservoir and spaced from and above said pool of liquid fuel and having a plurality of openings through said baffle for permitting returned fuel to pass through said baffle openings to be received by said pool of liquid fuel in said reservoir while substantially preventing said return fuel from impinging directly on said pool of liquid fuel and retarding fuel foaming for preventing fuel foam from adversely affecting the fuel pump or engine operation;

a fuel inlet below said baffle for enabling said reservoir to receive liquid fuel from a remote source;

an inlet valve associated with said inlet, and a float in said reservoir and operably connected with said inlet valve to open and close said inlet valve to maintain the level of said pool of liquid fuel in said reservoir below said baffle and above said outlet.

29. The fuel handling system of claim 1 which also comprises, an inlet valve associated with said inlet and a float disposed in said reservoir and operably connected with said inlet valve to open and close said inlet valve to maintain the level of the pool of liquid fuel in said reservoir below said baffle and above said outlet.

30. The fuel handling system of claim 24 which also comprises, an inlet valve associated with said inlet and a float disposed in said reservoir and operably connected with said inlet valve to open and close said inlet valve to maintain the level of the pool of liquid fuel in said reservoir below said baffle and above said outlet.

* * * * *